United States Patent [19]

Ashley et al.

[11] 3,996,837

[45] Dec. 14, 1976

[54] SEAL

[75] Inventors: Eugene Ashley, Burlington; Douglas P. Tassie, St. George, both of Vt.

[73] Assignee: General Electric Company, Burlington, Vt.

[22] Filed: May 8, 1975

[21] Appl. No.: 575,752

[52] U.S. Cl. ..... 89/26; 92/165 R; 277/212 F

[51] Int. Cl.[2] ..... F41D 11/00

[58] Field of Search ..... 89/26, 191 A; 92/165 R; 277/212 F

[56] References Cited

UNITED STATES PATENTS 3,728,937 4/1973 Nelson et al. ..... 89/26

3,810,412 5/1974 Zamacola ..... 89/191 A

FOREIGN PATENTS OR APPLICATIONS 397,361 2/1966 Switzerland ..... 277/212 F

*Primary Examiner*—Stephen C. Bentley
*Attorney, Agent, or Firm*—Bailin L. Kuch

[57] ABSTRACT

An L-shaped seal, for a gun firing caseless ammunition, is captured in and to the chamber of the gun, and is preseated against the surface of the bolt by plastic deformation effected as the gun bolt is rammed into the chamber.

4 Claims, 4 Drawing Figures

SEAL

BACKGROUND OF THE INVENTION

1. Field of the Invention

This invention relates to a preloaded annular seal for combustion apparatus, especially adapted for use in a liquid propellant gun. The invention herein described was made in the course of or under a contract with the Department of the Navy.

2. Prior Art

This invention is an improvement on the annular breech seal disclosed and claimed in my earlier patent, U.S. Pat. No. 3,783,737, issued Jan. 8, 1974. A liquid propellant gun which is well adapted to utilize the seal of the present invention is shown in U.S. Pat. No. 3,763,739, issued Oct. 9, 1973, to D. P. Tassie, to which reference may be had for details of the total system not herein shown.

High pressure resisting seals with an L-shape cross-section were disclosed in U.S. Pat. No. 3,783,737 as mounted on the bolt head, and preseated against the wall of the chamber by plastic deformation effected as the gun bolt was rammed into the firing position. These seals work well under the now normal chamber pressures of 50,000 to 60,000 psi. However, higher chamber pressures have been encountered. Under these higher pressures, the chamber elastically expands to provide a larger opening than normal, which permits the annular seal to expand to that larger opening which results in a plastic yielding of the seal. The seal, under these circumstances, develops a permanent enlargement and is then too tight against the chamber wall to be extracted by and with the bolt after firing.

SUMMARY OF THE INVENTION

It is an object of this invention to provide an improved combination of annular, L-shaped seal, bolt head and combustion chamber which will better support the seal against higher than normal chamber pressures.

A feature of this invention is the provision of an L-shaped seal which is captured in and to the chamber and which is presented against the surface of the bolt by plastic deformation effected as the gun bolt is rammed into the chamber.

BRIEF DESCRIPTION OF THE DRAWING

These and other objects, features, and advantages of the invention will be apparent from the following specification thereof taken in conjunction with the accompanying drawing in which.

DESCRIPTION OF THE INVENTION

In guns firing conventional cased ammunition, the interface between the combustion chamber and the gun bolt is sealed by the cartridge case.

In guns firing uncased ammunition using either a solid or a liquid propellant, the interface between the combustion chamber and the gun bolt must be provided by a seal element. Ideally, to provide a high rate of fire, the interface must be capable of being closed, and the seal made, in a very short time before firing, and opened, in a very short time after firing.

In U.S. Pat. No. 3,783,737 there is shown a seal which is carried by the gun bolt into a multi-diametered combustion chamber, and which chamber progressively centripetally deflects the seal to generate a preseating force thereon. As discussed previously, unconventionally high pressure on a seal made of conventional materials results in a permanent enlargement of such a seal.

Figure 1:
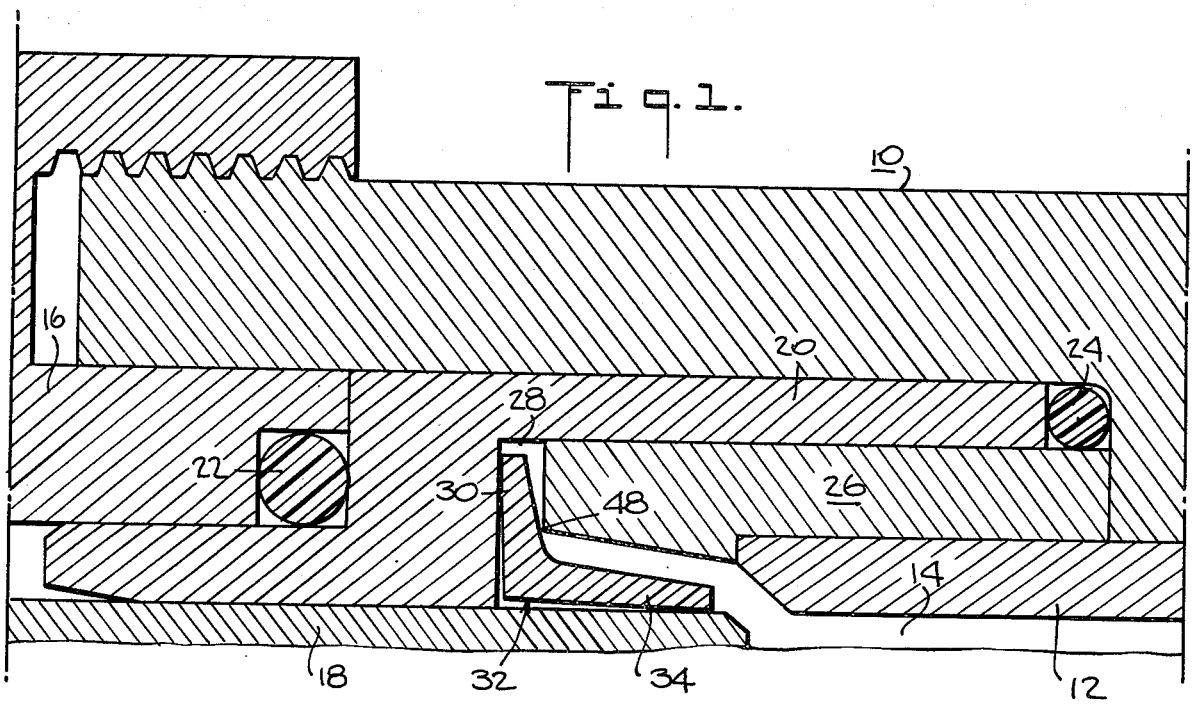
FIG. 1 is a detail view in longitudinal cross-section of a gun employing a seal embodying this invention.

FIG. 1 shows a liquid propellant gun having a gun barrel 10 having a barrel liner 12 which defines the combustion chamber 14, a receiver 16, and a gun bolt 18. An annular seal retainer 20 holds an 0-ring 22 against the receiver and an 0-ring 24 against the gun barrel to provide a static seal for the receiver/chamber interface. An annular spacer 26 is fixed within the retainer 20 to provide an annular lacuna 28 in which is disposed the transverse web 30 of an annular L-shaped metal seal 32. The longitudinal web 34 of the seal 32 extends into the chamber and engages the forward end of the gun bolt 18. The longitudinal thickness and the diameter of the lacuna are larger than the longitudinal thickness and the diameter, respectively, of the transverse web 30 of the seal 32. The seal 32 is thus free to float or slide transversely to permit auto-alignment with the forward end of the bolt.

Figure 2:
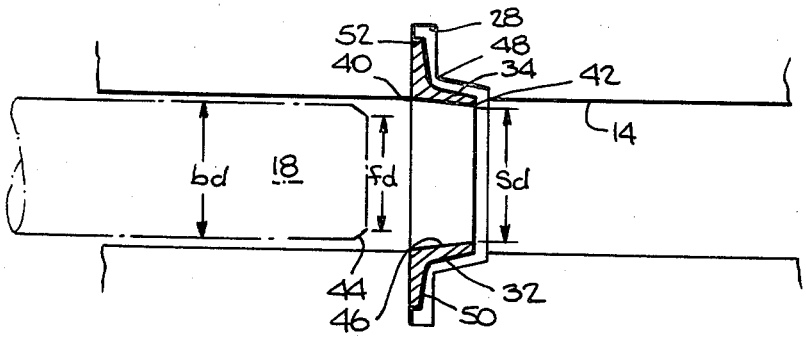
FIG. 2 is a schematic view in longitudinal cross-section with some exaggeration of the seal in its free state with the bolt clear of the chamber.

FIG. 2 shows the seal 32 in its free, floating state, with the bolt in its aft, unlocked disposition. The longitudinal web 34 tapers in thickness as it extends from the heel corner 40. The web 34 also diverges inwardly towards the longitudinal axis of the seal, so that the distal inner corner 42 has a diameter (sd) which is smaller than the diameter (bd) of the gun bolt. The forward end of the gun bolt 18 is chamfered at 44, so that the face of the gun bolt has a diameter (fd) which is smaller than the seal corner diameter (sd).

Figure 3:
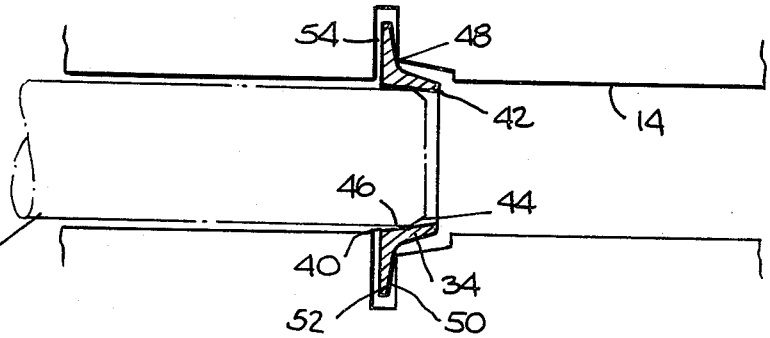
FIG. 3 is a schematic view similar to FIG. 2 showing the bolt partially inserted into the chamber.

FIG. 3 shows the gun bolt partially inserted into the seal. The aft edge of the chamfer 42 has engaged the inner wall 46 of the longitudinal web 34 to push the seal forward in the lacuna 28 until the aft inner corner 48 of the spacer 26 engages the forward face 50 of the transverse web 30 and makes a ring seal therewith.

Figure 4:
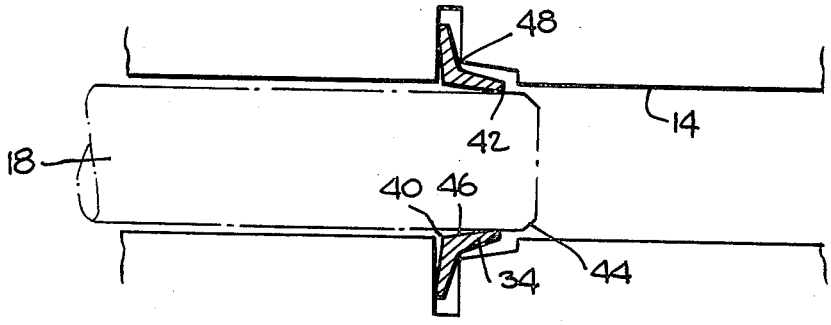
FIG. 4 is a schematic view similar to FIG. 2 showing the bolt fully inserted into the chamber.

FIG. 4 shows that as the gun bolt is projected further forwardly through the seal, it cams and stresses the longitudinal web 34 centrifugally to enlarge the diameter (sd) until it is equal to the diameter (bd) of the bolt. The corner 42 then wipes along the outer surface of the bolt and makes a ring seal therewith. As the longitudinal web is deflected centrifugally, the transverse web 30 is deflected aftwardly until the aft corner 52 engages the aft face 54 of the launa and makes a ring seal therewith.

When the bolt is withdrawn, the seal returns to its free state, as shown in FIG. 2.

When the gun is fired, the bolt is set-back, thereby pulling the original bolt sealing surface back under the longitudinal web and protecting that surface from exposure to the combustion gases. The opposite situation obtains in the system shown in U.S. Pat. No. 3,783,737 where the seal is mounted on the bolt and exposes the original chamber sealing surface upon set-back.

The "case stretch" effect, wherein the base of the conventional cartridge case is displaced aftwardly while the tube of the case is held stationary by frictional engagement with the wall of the chamber, is minimized in effect on the seal. The seal simply flattens its transverse web against the aft face 54 of the lacuna, while displacing the longitudinal web aft but maintaining its ring seal at the corner 42.

The bolt undergoes less radial (transverse) strain than does the chamber, so that the longitudinal web of the seal which is supported by the bolt wall undergoes less radial (transverse) strain than an equivalent seal supported by the chamber wall.

While the seal is supported by the bolt, it remains in the chamber and is protected thereby, as distinguished from a seal which travels with the bolt and is exposed to damage in the feeding environment.

What is claimed is:

1. A combustion apparatus comprising:

a vessel having a chamber;

an annular, L-shaped seal having a longitudinal bore and disposed in and loosely retained to said chamber;

a piston having a forward portion with a cylindrical external face disposed for reciprocation into and out of said chamber;

said forward portion of said piston upon entrance into said chamber passing entirely through said bore of said seal;

said seal being transversely annular and having a heel with a portion extending longitudinally therefrom having an inner, annular, approximately cylindrical face defining said bore and a portion extending transversely therefrom having an aft, annular approximately transverse face;

said inner face having a forward-most annular edge remote from said heel which is in the free state of said seal is less in internal diameter than the remainder of said inner face, and which in the free state is less than the external diameter of said forward portion of said piston; and said chamber having an annular recess therein into which said transversely extending portion of said seal is captured but has limited freedom of transverse movement.

2. An apparatus according to claim 1, wherein:

said forward portion of said piston during passage through said bore of said seal distorts said longitudinally extending portion of said seal radially outwardly so that said forward-most annular edge of said seal passes onto and makes a sealing engagement with said cylindrical external face of said piston.

3. An apparatus according to claim 2, wherein:

said annular recess of said chamber has an aft flat face; and said aft face of said transversely extending portion of said seal having an outermost annular edge remote from said heel which, when said longitudinally extending portion is distorted radially outwardly, is displaced aftwardly to make a sealing engagement with said aft flat face of said annular recess of said chamber.

4. An apparatus according to claim 3, wherein:

said apparatus is a gun;

said vessel is a gun barrel; and said piston is a gun bolt.

* * * * *